US005453070A

United States Patent [19]

Moody

[11] Patent Number: 5,453,070

[45] Date of Patent: Sep. 26, 1995

[54] SYSTEM FOR MANUFACTURING CORELESS ROLL PAPER PRODUCTS

[75] Inventor: John R. Moody, Antioch, Calif.

[73] Assignee: James River Paper Company, Inc., Richmond, Va.

[21] Appl. No.: 273,944

[22] Filed: Jul. 12, 1994

[51] Int. Cl.[6] ..... B31C 1/00; B31C 11/02; B26D 3/16; B65H 18/04

[52] U.S. Cl. ..... 493/288; 83/924; 83/267; 82/47; 82/89; 29/400.1; 242/525.6; 242/532.3

[58] Field of Search ..... 493/228, 230, 493/272, 288, 290; 83/329, 330, 267, 273, 944, 924; 242/525.6, 532.3; 477/154, 179, 232, 233, 358.2, 358.3, 425; 82/46, 47, 50, 89; 29/400.1

[56] References Cited

U.S. PATENT DOCUMENTS

| | | | |
|---|---|---|---|
| 1,917,187 | 7/1933 | Conti . | |
| 2,585,227 | 2/1952 | Christman | 242/56 |
| 2,585,227 | 2/1952 | Christman | 242/56 |
| 3,083,601 | 2/1958 | Leiss et al. | 82/50 |
| 3,320,841 | 4/1965 | Judelson | 493/306 |
| 3,323,399 | 3/1965 | Gerstein | 825/47 |
| 3,797,338 | 3/1974 | Molnar | 82/46 |
| 3,853,279 | 12/1974 | Gerstein | 242/56.2 |
| 3,856,226 | 12/1974 | Dowd | 242/56 R |
| 3,930,620 | 1/1976 | Taitel | 242/56 |
| 4,215,686 | 8/1980 | Stoffels | 82/53 |
| 4,487,378 | 12/1984 | Kobayashi | 242/68 |
| 4,611,769 | 9/1986 | Orbach | 242/56.9 |
| 4,630,783 | 12/1986 | Mulfarth | 242/56 A |
| 4,716,992 | 12/1987 | Languillet | 82/48 |
| 4,783,015 | 11/1988 | Shimizu | 242/1 |
| 5,271,137 | 12/1993 | Schutz | 29/400.1 R |
| 5,271,575 | 12/1993 | Weinert | 242/67.1 |
| 5,281,386 | 1/1994 | Weinert | 264/512 |
| 5,387,284 | 2/1995 | Moody | 242/525.7 |

*Primary Examiner*—Bruce M. Kisliuk
*Assistant Examiner*—Christopher W. Day
*Attorney, Agent, or Firm*—Thomas R. Lampe

[57] ABSTRACT

A system of forming a coreless roll paper product in which an elongated coreless paper roll is cut into segments by a saw. Prior to being cut from the elongated coreless paper roll, each roll segment is positioned on a support shaft located on a rotatable turret. The roll segment is severed while being supported by both an elongated mandrel and the support shaft, the blade passing through a space between the mandrel and support shaft. The turret has a number of spaced support shafts projecting therefrom, and rotation of the turret simultaneously brings the support shafts to various locations so that various steps in the operation are performed seriatim and simultaneously.

16 Claims, 4 Drawing Sheets

SYSTEM FOR MANUFACTURING CORELESS ROLL PAPER PRODUCTS

TECHNICAL FIELD

This invention relates to the manufacture of coreless roll paper products, such as rolls of tissue or toweling. More particularly, the invention pertains to both an apparatus and a method which involve the cutting of individual coreless roll product segments from an elongated coreless paper roll.

BACKGROUND ART

Many systems are known in the prior art for cutting elongated objects, including elongated rolls formed from web material, into individual sections or segments. U.S. Pat. No. 4,487,378, issued Dec. 11, 1984, discloses the approach of forming an elongated coreless cant or log of paper (such as paper toweling or tissue) on a mandrel having a polygonal cross-section. According to the teachings of the patent, the elongated log is pulled end-wise from the mandrel once it has been formed. A circular saw arrangement then cuts the completely removed log or cant into individual towel or tissue rolls. A problem presents itself when utilizing this prior art approach since the saw crushes the center of the roll to some degree, resulting in distortion, or even virtual loss, of the polygonal opening through the center of the roll which was caused by, and corresponds to, the mandrel shape. This can make the rolls unsuitable for subsequent use on coreless roll holders.

U.S. Pat. No. 5,271,137, issued Dec. 21, 1993, relates to a method of forming a coreless paper roll product wherein an elongated coreless paper roll is removed from the end of a forming mandrel in intermittent steps. The elongated coreless paper roll is then cut seriatim into coreless roll product segments with a saw blade located immediately adjacent to the mandrel end. No positive support is provided for the roll product segment being detached during sawing.

U.S. Pat. No. 5,271,575, issued Dec. 21, 1993, discloses a system for forming coreless paper rolls having a center aperture of a predetermined cross-sectional configuration. The coreless paper roll is initially formed by winding a web about a first mandrel element having a first cross-sectional configuration and a distal end differing from the predetermined cross-sectional configuration. After the roll is formed, it is slid over a second mandrel element affixed to the distal end of the first mandrel element to change the shape of the coreless paper roll center aperture from the first cross-sectional configuration to the predetermined cross-sectional configuration. In this arrangement, the entire roll is stripped intact from the connected mandrel elements.

U.S. Pat. No. 5,281,386, issued Jan. 25, 1994, discloses an approach for forming a coreless paper roll having a specifically shaped central aperture. A probe is inserted into the central aperture of the roll after the winding mandrel has been removed from the roll to change a configuration of the central aperture over at least a portion of the length thereof.

Other patents of some relevance to the present invention of which applicant is aware are the following: U.S. Pat. No. 4,611,769, issued Sep. 16, 1986, U.S. Pat. No. 4,630,783, issued Dec. 23, 1986, U.S. Pat. No. 3,930,620, issued Jan. 6, 1976, U.S. Pat. No. 3,853,279, issued Dec. 10, 1994, U.S. Pat. No. 2,585,227, issued Feb. 12, 1952, and U.S. Pat. No. 1,917,187, issued Jul. 4, 1933.

DISCLOSURE OF INVENTION

The method of the present invention includes the step of placing an elongated mandrel having an elongated coreless paper roll wrapped thereabout and a shaft into substantially axial alignment, the elongated mandrel being located in a central opening defined by the elongated coreless paper roll.

While the elongated mandrel and the shaft are substantially axially aligned, the elongated coreless paper roll is moved axially along the elongated mandrel toward the shaft. During the step of axially moving the elongated coreless paper roll, the elongated coreless paper roll is brought into engagement with the shaft.

After bringing the elongated coreless paper roll into engagement with the shaft and during the step of axially moving the elongated coreless paper roll, the shaft is positioned in the central opening defined by the elongated coreless paper roll.

Axial movement of the elongated coreless paper roll is terminated after a roll segment of the elongated coreless paper roll is located on the shaft.

The roll segment is severed from the remainder of the elongated coreless paper roll while the roll segment is located on the shaft. The roll segment is supported on the shaft.

The apparatus of the present invention includes an elongated mandrel for supporting an elongated coreless paper roll, the elongated coreless paper roll being formed from a plurality of paper convolutions and having an innermost convolution defining a central aperture receiving the elongated mandrel. The elongated mandrel has a mandrel end.

The apparatus also includes a shaft having a shaft end. Placement means including shaft support means is provided for placing the elongated mandrel and the shaft into substantial axial alignment with the mandrel end and shaft end adjacent to one another.

Means is provided for moving the elongated coreless paper roll axially along the elongated mandrel toward and onto the shaft whereby a roll segment of the elongated coreless roll projects beyond the mandrel end and is located on the shaft.

Severing means is provided for severing the roll segment from the remainder of the elongated coreless paper roll while the roll segment is located on the shaft whereby the roll segment will be supported by the shaft during and after the roll segment is severed from the remainder of the elongated coreless paper roll by the severing means.

The shaft end and the mandrel end define a space therebetween. The severing means comprises a saw passing through the space to cut the roll segment from the remainder of the elongated coreless paper roll.

The shaft support means includes a rotatable turret connected to the shaft for moving the shaft away from the elongated mandrel after the roll segment has been severed from the remainder of the elongated coreless paper roll and while the roll segment is supported by the shaft.

Other features, advantages, and objects of the present invention will become apparent with reference to the following description and accompanying drawings.

BEST MODE FOR CARRYING OUT THE INVENTION

Figure 1:
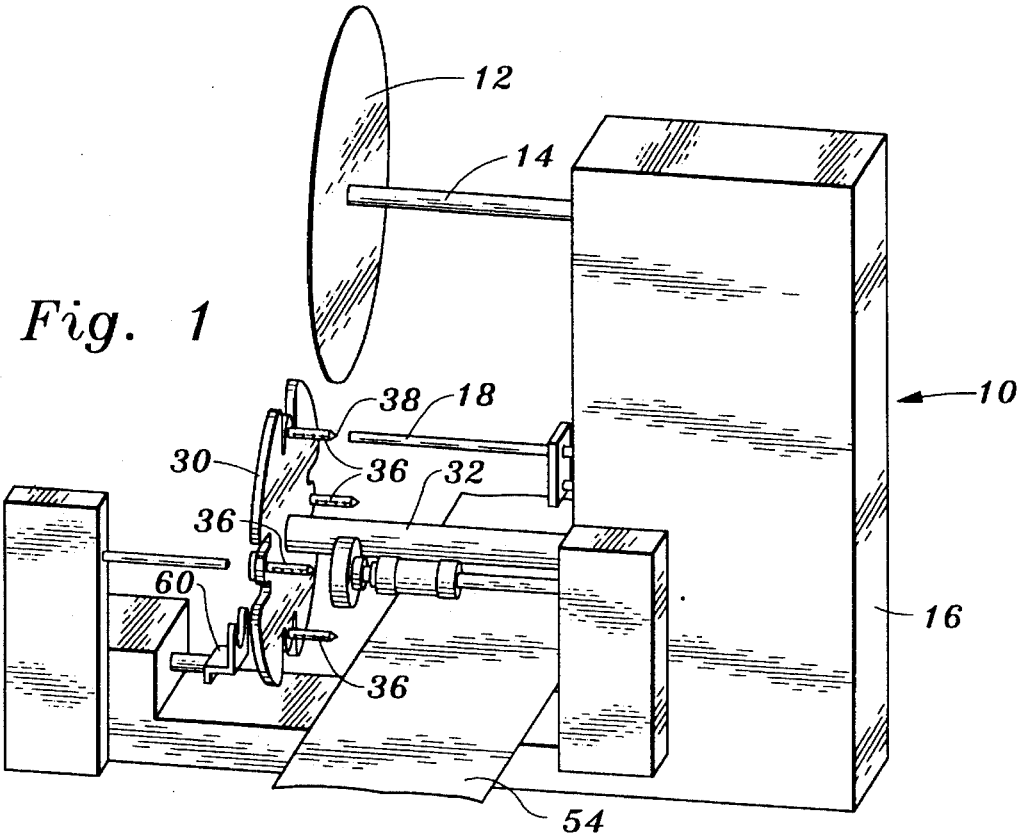
FIG. 1 is a perspective view of apparatus constructed in accordance with the teachings of the present invention.
Figure 2:
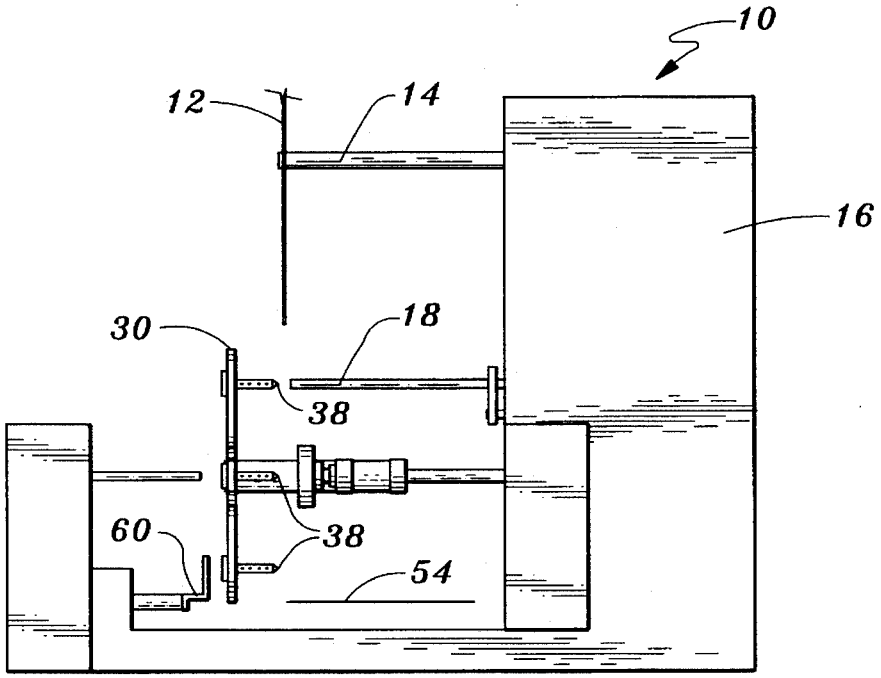
FIG. 2 is a front elevation view of the apparatus.
Figure 3:
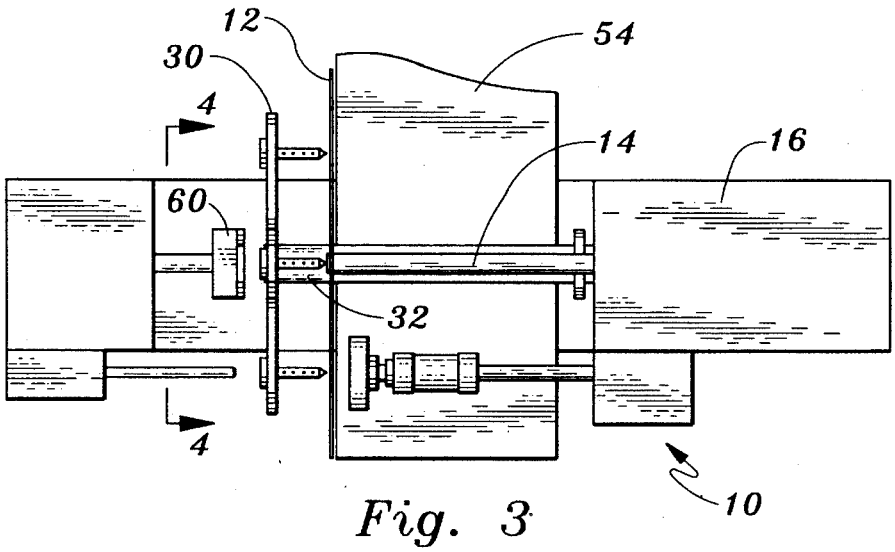
FIG. 3 is a top plan view of the apparatus.
Figure 4:
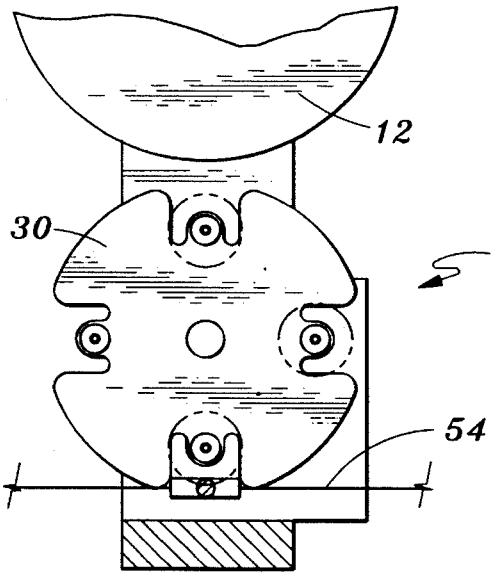
FIG. 4 is an enlarged sectional view taken along the line 4—4 in FIG. 3.

Referring now to the drawings, apparatus 10 constructed in accordance with the teachings of the present invention is illustrated. Apparatus 10 includes a saw having a rotatable saw blade 12. Blade 12 is mounted on a shaft 14 projecting from a housing 16.

Also projecting from housing 16 is a rotatable elongated winder mandrel 18. As is the case with respect to shaft 14, mandrel 18 is operatively associated with suitable conventional mechanism within housing 16 to be selectively rotated to carry out the operations of the apparatus in a manner which will be described below. Since mandrel and shaft driving systems are well known per se and do not form part of the present invention; they will not be described in detail. Suffice it to say that the mandrel 18, as is well-known in the winding art, is utilized to form an elongated roll 20 thereabout. The elongated mandrel is, essentially, a winding shaft for winding a paper web thereabout for forming the elongated coreless paper roll. This is accomplished, as is conventional, by attaching the lead end (not shown) of a paper web to the mandrel and rotating the mandrel, thus forming elongated paper roll 20. FIGS. 5 through 9 show a completely formed roll 20.

In the present instance, roll 20 is a coreless paper roll, not employing a central core of paperboard or the like. That is, the elongated roll has a central opening 22 (shown in dash lines in FIG. 5) which is defined by the innermost convolution of elongated roll 20, the innermost convolution, of course, being in engagement with the elongated mandrel 18. Thus, the cross-sectional shape of the central opening 22 is substantially the shape of the outer peripheral surface of the elongated mandrel 18. The elongated mandrel 18 has an end 24.

A rotatable turret 30 is mounted on a rotatable turret shaft 32 extending from housing 16. Upon rotation of turret shaft 32 through any suitable mechanism disposed in housing 16, the turret 30 itself will also rotate.

Extending outwardly from turret 30 are a plurality of support shafts 36. Support shafts 36 are of identical construction and are spaced from one another adjacent to the outer periphery of turret 30. In the arrangement shown, there are four such support shafts 36 and they are located equidistant from one another on the turret. Each support shaft 36 has a pointed end 38.

Figure 5:
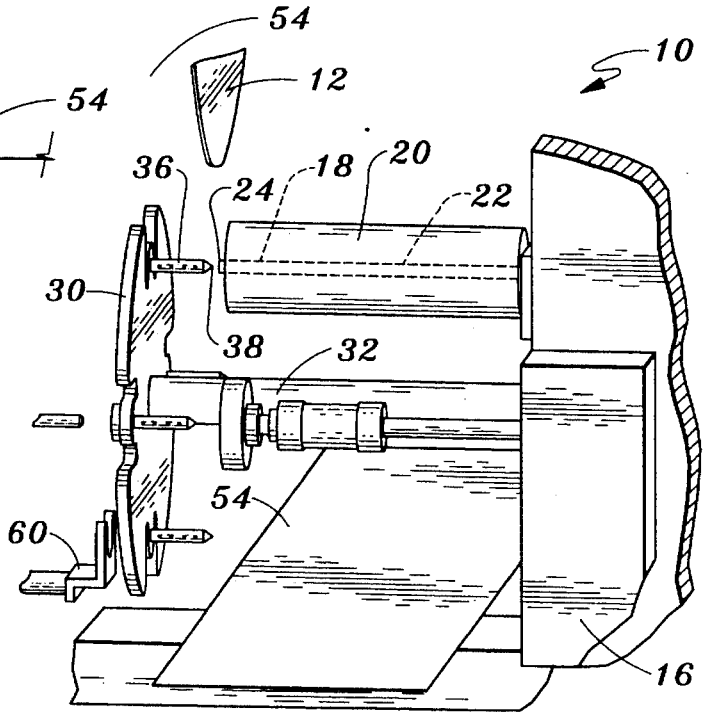
FIGS. 5 through 9 are partial sectional, perspective views of the apparatus illustrating the structural components thereof in the relative positions assumed thereby during sequential stages of operation of the apparatus.

FIG. 5 shows the relative positions assumed by the structural components of the apparatus of the present invention just prior to operation thereof to form individual coreless roll paper products from the elongated coreless paper roll 20 disposed about elongated mandrel 18. It will be noted that the turret 30 is so positioned that one of the support shafts 36 is substantially axially aligned with the elongated mandrel 18. The pointed end 38 of the uppermost shaft 36, i.e. the shaft substantially aligned with the elongated mandrel, defines a space with the end 24 of the elongated mandrel.

With the turret in the position shown in FIG. 5, the elongated roll 20 is slid axially along elongated mandrel 18 toward the support shaft 36 in alignment therewith by a pusher device 46 which defines a hole slidably accommodating mandrel 18. The pusher device 46 extends from housing 16 and utilizes a suitable prime mover (not shown), such as a hydraulic cylinder, to effect axial movement of the elongated roll 20 by pushing thereagainst.

It will be appreciated that the saw blade 12 is in the elevated position illustrated in FIG. 5 when the elongated roll 20 is axially moved along mandrel 18 so as not to interfere with such movement.

Axial movement of the elongated roll 20 under the urging of pusher device 46 will cause the elongated coreless paper roll to cross the space defined by the shaft end and the mandrel end and to engage the end of the uppermost support shaft 36. The pointed end of the support shaft will enter the central opening 22 of the elongated roll, and continued movement of the elongated roll 20 toward the turret 30 will cause the uppermost support shaft 36 to enter the elongated coreless paper roll. It will be appreciated that when this occurs the elongated roll 20 will be supported and held in a stable manner by both the elongated mandrel and the support shaft positioned therein.

Figure 6:
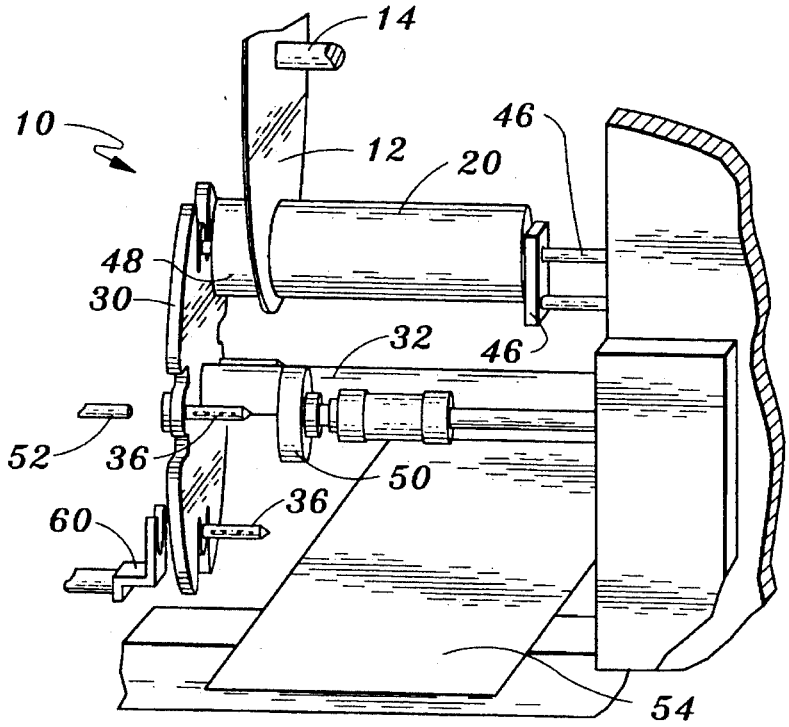

Next the saw blade 12 is lowered by any suitable mechanism in housing 16 from its elevated position shown in FIG. 5 to the lower position shown in FIG. 6. The saw blade 12 is aligned with the space between the support shaft end and the elongated mandrel end; thus, the saw blade, which is rotating, can readily pass through the elongated roll 20 as shown in FIG. 6 and sever therefrom a section or segment which is supported solely by its associated support shaft 36. It will be appreciated that such cutting or severing only takes place after a desired length of coreless roll paper product has been positioned on the support shaft and after axial movement of the elongated coreless paper roll 20 has stopped due to cessation of movement of pusher device 46. Since the elongated roll 20 is positively supported at both ends thereof, i.e. on both sides of the cut being made by the saw blade 12, a very clean cut can be made by the saw blade without undue distortion of the shape of the roll or its central opening. The severed roll segment is designated in the drawings by reference numeral 48.

Figure 7:
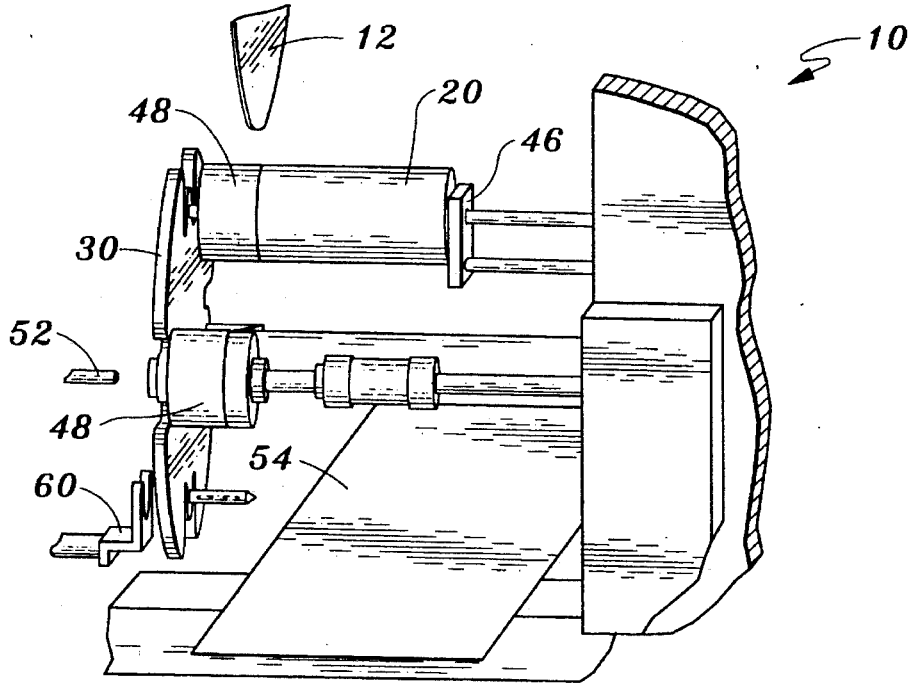

After the severing or cutting step, the saw blade 12 is again moved to its elevated position, as shown in FIG. 7, and the turret 30 is rotated 90 degrees by turret shaft 32. This brings the just-severed roll segment 48 into registry with a ram device 50 which may be electrically or hydraulically operated for example. Ram device 50 is extended to push the roll segment 48 in registry therewith fully onto its associated support shaft 36.

It will be appreciated that the apparatus 10 forms a plurality of roll segments 48 through the operations described above until the elongated roll 20 has been completely divided into roll segments. FIG. 7 illustrates a situation wherein another support shaft 36 has been indexed into place at the top of the turret and a roll segment 48 already created at such location at the time its predecessor roll segment 48 is seated fully on its associated support shaft 36 by the ram device 50.

Figure 8:
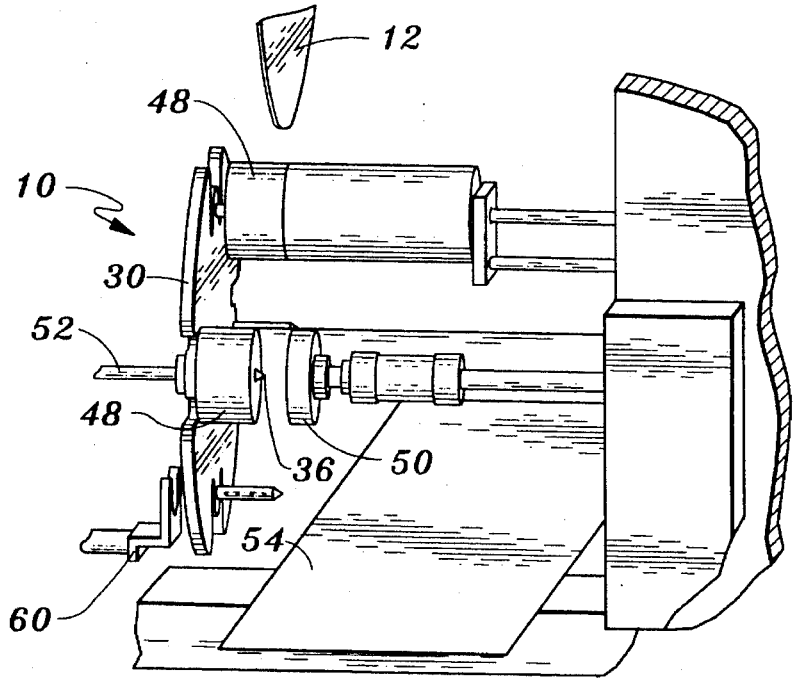

After a roll segment 48 has been fully seated on its associated support shaft 36, as shown for example in FIG. 8, the ram device 50 is retracted out of engagement therewith. A suitable mechanism then brings a conduit 52 connected to a source of water or other liquid (not shown) into communication with the support shaft supporting the fully seated roll segment 48.

Such support shaft, as is the case with all of the support shafts, is hollow and has a plurality of openings in the cylindrical surface thereof communicating with the support shaft interior.

Figure 9:
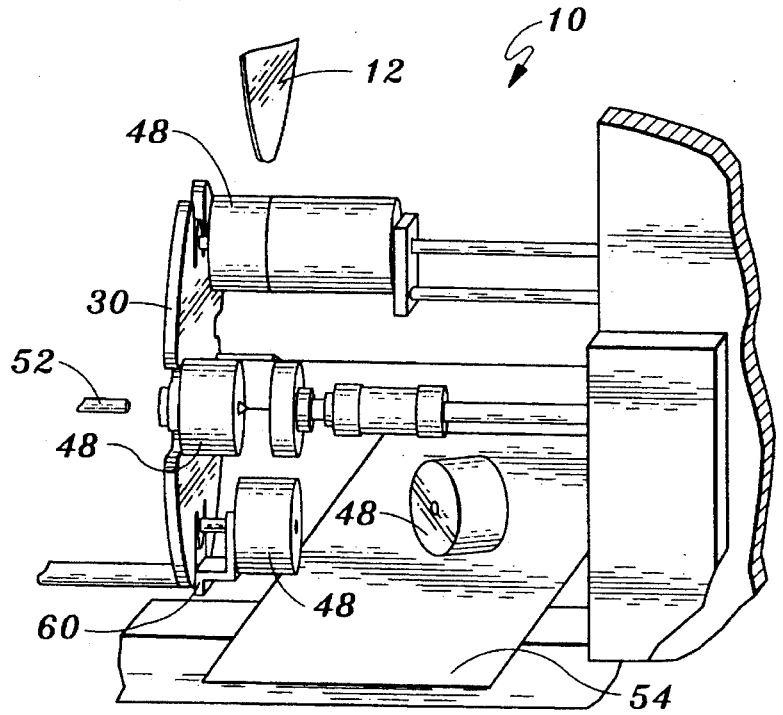

The purpose of the arrangement just described is to inject water or other suitable liquid through the support shaft and into engagement with the innermost convolutions of the roll segment 48 fully seated thereon. This will cause the innermost convolutions to be wetted somewhat, resulting in the central opening thereof retaining the shape of the support shaft 36 when the roll segment is removed therefrom. The turret is now again indexed 90 degrees to place the roll segment 48 which was just moistened at the bottom of the turret and just above a conveyor belt 54. An extractor in the form of a pusher element 60 is then actuated through any suitable prime mover to move from the position shown in FIG. 8 to that shown in FIG. 9. The extractor will engage the moistened roll segment 48 and push it from its support shaft onto the conveyor belt 54. FIG. 9 illustrates one roll segment 48 already on the conveyor belt and another in the process of being removed from its associated shaft 36 by the extractor 60.

I claim:

1. A method of forming a coreless roll paper product, said method comprising the steps of:

placing an elongated mandrel having an elongated coreless paper roll wrapped thereabout and a shaft into substantially axial alignment, said elongated mandrel being located in a central opening defined by said elongated coreless roll;

while said elongated mandrel and said shaft are substantially axially aligned, moving said elongated coreless paper roll axially along said elongated mandrel toward said shaft;

during the step of axially moving said elongated coreless paper roll, bringing said elongated coreless paper roll into engagement with said shaft;

positioning said shaft in the central opening defined by said elongated coreless paper roll;

terminating axial movement of said said elongated coreless paper roll after a roll segment of said elongated coreless paper roll is located on said shaft;

severing said roll segment from the remainder of said elongated coreless paper roll while said roll segment is located on said shaft; and supporting said roll segment on said shaft.

2. The method according to claim 1 wherein the elongated mandrel and shaft define a space therebetween when substantially axially aligned, said severing step being carried out by moving a saw through said space after terminating axial movement of said elongated coreless paper roll and cutting the elongated coreless paper roll with said saw.

3. The method according to claim 1 including the step of relatively moving said shaft away from said elongated mandrel after said severing step and while said roll segment is supported on said shaft.

4. The method according to claim 1 including the step of moistening inner convolutions of said roll segment while said roll segment is on said shaft.

5. The method according to claim 4 including the step of removing said roll segment from said shaft after the step of moistening inner convolutions of said roll segment.

6. The method according to claim 1 including the additional step of axially moving said roll segment relative to said shaft while said roll segment is supported on said shaft and after said severing step.

7. The method according to claim 3 wherein said shaft is on a rotatable turret, the step of relatively moving said shaft away from said elongated mandrel including rotating said turret.

8. The method according to claim 7 wherein the shaft supporting said roll segment is one of a plurality of shafts on said turret, said plurality of shafts being spaced from one another on said turret, said method including the step bringing another of said plurality of shafts into substantial axial alignment with said elongated mandrel as the shaft supporting said roll segment is moved away from said elongated mandrel during rotation of said turret.

9. Apparatus for forming a coreless roll paper product, said apparatus comprising, in combination:

an elongated mandrel for supporting an elongated coreless paper roll, said elongated coreless paper roll being formed from a plurality of paper convolutions and having an innermost convolution defining a central opening receiving said elongated mandrel, said elongated mandrel having a mandrel end;

a shaft having a shaft end;

placement means including shaft support means for placing said elongated mandrel and said shaft into substantial axial alignment with the mandrel end and shaft end adjacent to one another;

means for moving said elongated coreless paper roll axially along said elongated mandrel toward and on to the shaft substantially in alignment therewith whereby a roll segment of said elongated coreless roll projects beyond said mandrel end and is located on said shaft; and severing means for severing the roll segment from the remainder of said elongated coreless paper roll while said roll segment is located on said shaft whereby said roll segment will be supported by said shaft during and after the roll segment is severed from the remainder of the elongated coreless paper roll by said severing means.

10. The apparatus according to claim 9 wherein said shaft end and said mandrel end define a space therebetween, said severing means comprising a saw passing through said space to cut the roll segment from the remainder of said elongated coreless paper roll.

11. The apparatus according to claim 9 wherein said shaft support means includes a rotatable turret connected to said shaft for moving said shaft away from said elongated mandrel after said roll segment has been severed from the remainder of said elongated coreless paper roll and while said roll segment is supported by said shaft.

12. The apparatus according to claim 11 wherein a plurality of shafts are connected to said turret, rotation of said turret placing said shafts seriatim into substantial alignment with said elongated mandrel.

13. The apparatus according to claim 9 wherein said elongated mandrel is a winding shaft for winding a paper web thereabout for forming said elongated coreless paper roll.

14. The apparatus according to claim 9 additionally comprising moistening means for moistening inner convolutions of said roll segment while said roll segment is on said shaft.

15. The apparatus according to claim 14 additionally comprising roll segment removal means for removing said roll segment from said shaft after the inner convolutions of said roll segment have been moistened by said moistening means.

16. The apparatus according to claim 9 additionally comprising roll segment mover means for axially sliding said roll segment on said shaft while said roll segment is supported by said shaft and after the roll segment has been severed from the remainder of the elongated coreless paper roll by said severing means.

* * * * *